US008834046B2

(12) United States Patent
Hoffman et al.

(10) Patent No.: US 8,834,046 B2
(45) Date of Patent: Sep. 16, 2014

(54) INVERTED REVERSE-IMAGE TRANSFER PRINTING

(75) Inventors: Ted M. Hoffman, Eden Prairie, MN (US); Jeffrey L. Stangler, Eagan, MN (US); John P. Skoglund, Minneapolis, MN (US); Thomas G. Gale, Jr., Robbinsdale, MN (US); Tony Nauth, Bloomington, MN (US)

(73) Assignee: Assa Abloy AB, Stockholm (SE)

( * ) Notice: Subject to any disclaimer, the term of this patent is extended or adjusted under 35 U.S.C. 154(b) by 1359 days.

(21) Appl. No.: 11/683,850

(22) Filed: Mar. 8, 2007

(65) Prior Publication Data

US 2008/0216688 A1 Sep. 11, 2008

(51) Int. Cl.
*B41J 35/00* (2006.01)
*B41J 2/325* (2006.01)

(52) U.S. Cl.
CPC ..... *B41J 2/325* (2013.01)
USPC ..... 400/191; 400/120.01; 400/207

(58) Field of Classification Search
USPC ..... 400/191
See application file for complete search history.

(56) References Cited

U.S. PATENT DOCUMENTS

| | | | |
|---|---|---|---|
| 2,401,719 | A | 6/1946 | Braun |
| 3,513,957 | A | 5/1970 | Ricciardi et al. |
| 3,731,781 | A | 5/1973 | Caudill et al. |
| 3,889,795 | A | 6/1975 | Garberi et al. |
| 3,899,065 | A | 8/1975 | Brignole |
| 3,933,350 | A | 1/1976 | Mignano |
| 3,948,506 | A | 4/1976 | Crimmins et al. |
| 3,961,785 | A | 6/1976 | Gall |
| 3,975,010 | A | 8/1976 | Schisselbauer et al. |
| 4,299,504 | A | 11/1981 | Benz et al. |
| 4,305,577 | A | 12/1981 | Clay et al. |
| 4,458,890 | A | 7/1984 | Kawazu |
| 4,527,149 | A | 7/1985 | Swensen |
| 4,568,074 | A | 2/1986 | Murayoshi |
| 4,590,486 | A | 5/1986 | Yana |
| 4,592,634 | A | 6/1986 | Koch |
| 4,607,832 | A | 8/1986 | Abe |
| 4,609,298 | A | 9/1986 | Shioda |
| 4,615,628 | A | 10/1986 | Swinburne |

(Continued)

FOREIGN PATENT DOCUMENTS

| | | | |
|---|---|---|---|
| JP | 07040615 | A | 2/1995 |
| JP | 07256755 | A | 10/1995 |

(Continued)

OTHER PUBLICATIONS

Search Report and Written Opinion dated May 30, 2008 for International Application No. PCT/US2008/000853.

(Continued)

*Primary Examiner* — Jill Culler
(74) *Attorney, Agent, or Firm* — Brian D. Kaul; Westman, Champlin & Koehler, P.A.

(57) ABSTRACT

A credential printing device is provided. The credential printing device includes a credential substrate transport, a transfer ribbon and a transfer roller. The credential substrate transport is configured to feed a credential substrate along a processing path. The transfer ribbon is adjacent to the processing path. The transfer roller is positioned below the processing path and is configured to transfer an image from the transfer ribbon to a bottom surface of the credential substrate in the processing path.

23 Claims, 4 Drawing Sheets

(56) References Cited

U.S. PATENT DOCUMENTS

| | | | | |
|---|---|---|---|---|
| 4,673,304 | A | 6/1987 | Liu et al. | |
| 4,676,678 | A | 6/1987 | Watanabe | |
| 4,685,815 | A | 8/1987 | Baranyi | |
| 4,687,358 | A | 8/1987 | Saitou | |
| 4,869,455 | A | 9/1989 | Weeks | |
| 4,938,616 | A | 7/1990 | Shiozaki et al. | |
| 4,990,008 | A | 2/1991 | Hwang | |
| 5,004,218 | A | 4/1991 | Sardano et al. | |
| 5,037,216 | A | 8/1991 | Nubson et al. | |
| 5,050,852 | A | 9/1991 | Sawada et al. | |
| 5,064,301 | A | 11/1991 | Nakamura et al. | |
| 5,079,565 | A | 1/1992 | Shimizu et al. | |
| 5,102,116 | A | 4/1992 | Garavuso | |
| 5,220,355 | A | 6/1993 | Miyawaki | |
| 5,229,586 | A * | 7/1993 | Ishii | 235/375 |
| 5,239,926 | A | 8/1993 | Nubson et al. | |
| 5,301,834 | A | 4/1994 | Lee et al. | |
| 5,366,306 | A | 11/1994 | Mizutani et al. | |
| 5,453,852 | A | 9/1995 | Morikawa et al. | |
| 5,519,429 | A | 5/1996 | Zwijsen et al. | |
| 5,546,115 | A * | 8/1996 | Nardone et al. | 347/214 |
| 5,547,298 | A | 8/1996 | Wouters et al. | |
| 5,558,449 | A | 9/1996 | Morgavi | |
| 5,597,248 | A | 1/1997 | Burgin | |
| 5,739,835 | A | 4/1998 | Morgavi et al. | |
| 5,769,548 | A | 6/1998 | Thompson et al. | |
| 5,829,631 | A | 11/1998 | Kasper | |
| 5,895,157 | A | 4/1999 | Morimura et al. | |
| 5,936,646 | A | 8/1999 | Kenny et al. | |
| 5,941,522 | A * | 8/1999 | Hagstrom et al. | 271/225 |
| 6,151,478 | A | 11/2000 | Katsuta et al. | |
| 6,261,012 | B1 * | 7/2001 | Haas et al. | 400/208 |
| 6,390,697 | B1 | 5/2002 | O'Mera et al. | |
| 6,422,554 | B1 | 7/2002 | Wuethrich et al. | |
| 6,486,904 | B1 * | 11/2002 | Onozato et al. | 347/213 |
| 6,550,761 | B1 | 4/2003 | Chiang | |
| 6,604,876 | B2 | 8/2003 | Bryant et al. | |
| 6,616,360 | B2 | 9/2003 | Lehmkuhl | |
| 6,626,298 | B2 | 9/2003 | Lax | |
| 6,626,594 | B1 | 9/2003 | Lallemant | |
| 6,650,351 | B2 | 11/2003 | Yamamoto et al. | |
| 6,682,241 | B2 | 1/2004 | Coons et al. | |
| 6,714,228 | B1 | 3/2004 | Holland et al. | |
| 6,827,509 | B2 * | 12/2004 | Suden et al. | 400/120.01 |
| 6,910,656 | B2 | 6/2005 | Lysiak et al. | |
| 7,018,117 | B2 | 3/2006 | Meier et al. | |
| 7,549,633 | B2 | 6/2009 | Nishitani et al. | |
| 2001/0046401 | A1 * | 11/2001 | Lien et al. | 400/240 |
| 2002/0172537 | A1 | 11/2002 | Hamisch, Jr. et al. | |
| 2003/0025781 | A1 | 2/2003 | Honma et al. | |
| 2004/0022572 | A1 | 2/2004 | Bungert et al. | |
| 2004/0109715 | A1 * | 6/2004 | Meier et al. | 400/191 |
| 2004/0114981 | A1 | 6/2004 | Meier et al. | |
| 2005/0078998 | A1 * | 4/2005 | Lien et al. | 400/703 |
| 2005/0095049 | A1 | 5/2005 | Yoshida et al. | |
| 2005/0242487 | A1 | 11/2005 | Pelletier et al. | |
| 2007/0086823 | A1 | 4/2007 | Lodwig et al. | |

FOREIGN PATENT DOCUMENTS

| | | | |
|---|---|---|---|
| JP | 10016186 | A | 1/1998 |
| WO | 2004011268 | A1 | 2/2004 |
| WO | WO 2005/096724 | | 3/2005 |
| WO | 2005096724 | A2 | 10/2005 |

OTHER PUBLICATIONS

Search Report and Written Opinion dated Jun. 26, 2008 for International Application No. PCT/US2008/001031.
Search Report and Written Opinion dated Jun. 26, 2008 for International Application No. PCT/US2008/002207.
Search Report and Written Opinion dated Jun. 4, 2008 for International Application No. PCT/US2008/000851.

* cited by examiner

INVERTED REVERSE-IMAGE TRANSFER PRINTING

CROSS-REFERENCE TO RELATED APPLICATIONS

This application incorporates herein by reference in their entirety the following applications filed on Mar. 8, 2007: U.S. patent application Ser. No. 11/683,771 entitled "SUBSTRATE FEEDING IN A CREDENTIAL PRODUCTION DEVICE" having inventors Ted M. Hoffman, Jeffrey L. Stangler, John P. Skoglund and Tony Nauth; U.S. patent application Ser. No. 11/683,795 entitled "CARD HOLDER FOR A CREDENTIAL PRODUCTION DEVICE" having inventors Ted M. Hoffman, Jeffrey L. Stangler and John P. Skoglund; U.S. patent application Ser. No. 11/683,816 entitled "CREDENTIAL PRODUCTION PRINT RIBBON AND TRANSFER RIBBON CARTRIDGES" having inventor Ted M. Hoffman; U.S. patent application Ser. No. 11/683,827 entitled "PRINTHEAD ASSEMBLY FOR A CREDENTIAL PRODUCTION DEVICE" having inventor Ted M. Hoffman; U.S. patent application Ser. No. 11/683,835 entitled "CANTILEVERED CREDENTIAL PROCESSING DEVICE COMPONENT" having inventors Ted M. Hoffman and Thomas G. Gale Jr.; and U.S. patent application Ser. No. 11/683,710 entitled "CREDENTIAL PRODUCTION DEVICE HAVING A UNITARY FRAME" having inventors Ted M. Hoffman and James R. Cedar.

FIELD OF THE INVENTION

The present invention is generally directed to a credential production device. More particularly, the present invention is directed to a reverse-image credential printing device, in which a reverse-image is transferred to a bottom surface of a credential substrate.

BACKGROUND OF THE INVENTION

Credentials include, for example, identification cards, driver's licenses, passports, and other valuable documents. Such credentials are formed from credential substrates including paper substrates, plastic substrates, cards and other materials. Such credentials generally include printed information, such as a photo, account numbers, identification numbers, and other personal information that is printed on the credential substrates using a print consumable, such as ink and ribbon.

Credential production devices process credential substrates by performing at least one step in forming a final credential product. One type of credential production device is a reverse-image credential printing device. Reverse-image credential production devices generally include a printing section and an image transfer section. The printing section utilizes an intermediate transfer film or transfer ribbon, a print ribbon and a printhead. The printhead is typically a thermal printhead that operates to heat different colored dye panels of a thermal print ribbon to transfer the colored dye from the print ribbon to a panel of transfer film to form the image thereon. After the printed image on the transfer film is registered with a substrate, a heated transfer roller of the image transfer section transfers the image from the transfer film or transfer ribbon to a surface of the substrate.

Conventional reverse-image credential printing devices are typically large, cumbersome and complicated machines where improvements to these types of machines are in continuous demand. For example, there is a continuous demand for improving the process by which credential substrates are printed. In general, reverse-image printing devices print to a top surface of a credential process, yet still take advantage of gravity to output a printed credential into a hopper. Such a configuration requires that the printing device have a large and cumbersome height to accommodate internal credential processes.

Embodiments of the present invention provide solutions to these and other problems, and offer other advantages over the prior art.

SUMMARY OF THE INVENTION

Embodiments of the invention are directed to a reverse-image credential printing device. In one embodiment, the credential production device includes a credential substrate transport that is configured to feed a credential substrate along a processing path. A transfer ribbon is adjacent to the processing path. The credential production device also includes a transfer roller positioned below the processing path. The transfer roller is configured to transfer an image from the transfer ribbon to a bottom surface of the credential substrate in the processing path.

Another embodiment of the invention is directed to a method of processing a credential substrate in a credential production device. Embodiments of the method include the credential substrate being fed along a processing path that overlies a transfer roller of the device. A transfer film is provided that carries an image between the transfer roller and a bottom surface of the substrate. The image is transferred from the transfer film to the bottom surface of the credential substrate using the transfer roller.

DETAILED DESCRIPTION OF ILLUSTRATIVE EMBODIMENTS

Figure 1:
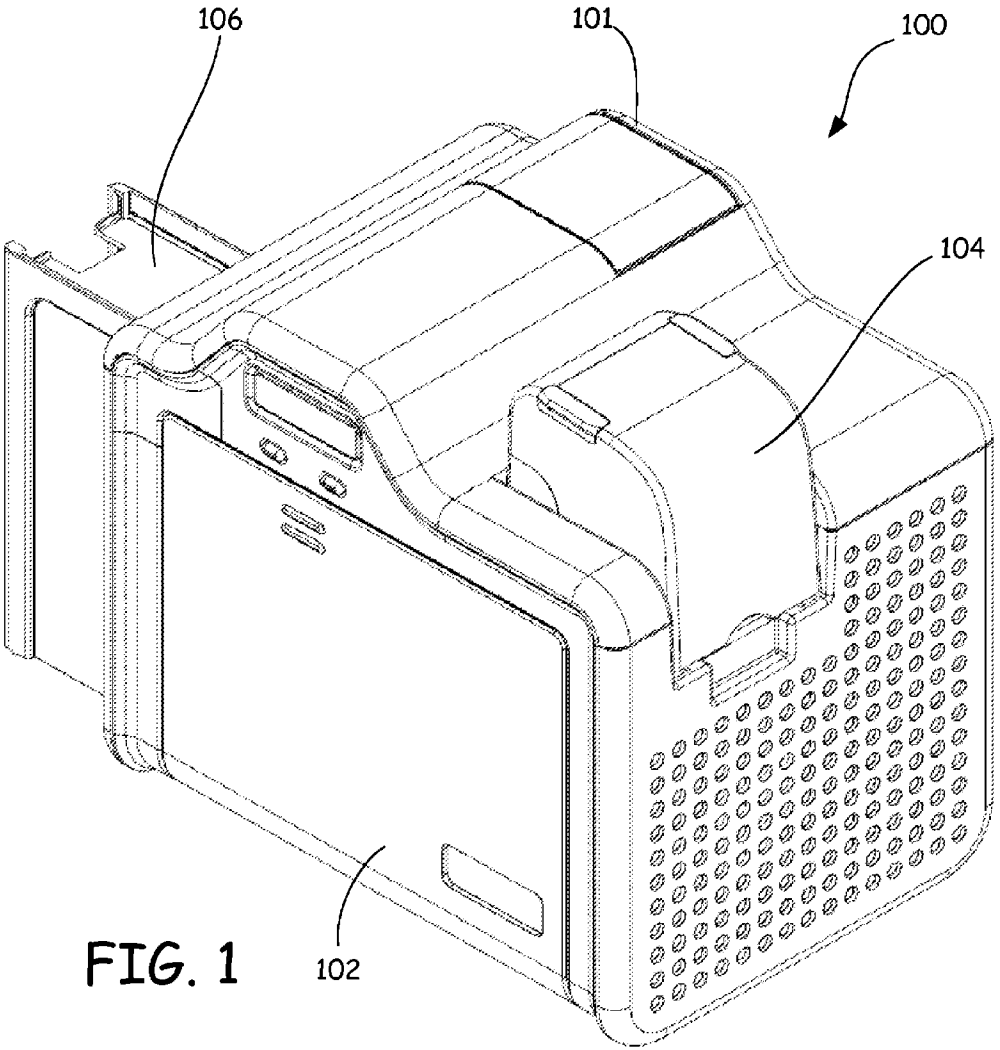
FIG. 1 is a perspective view of a credential printing device under embodiments of the invention.
Figure 2:
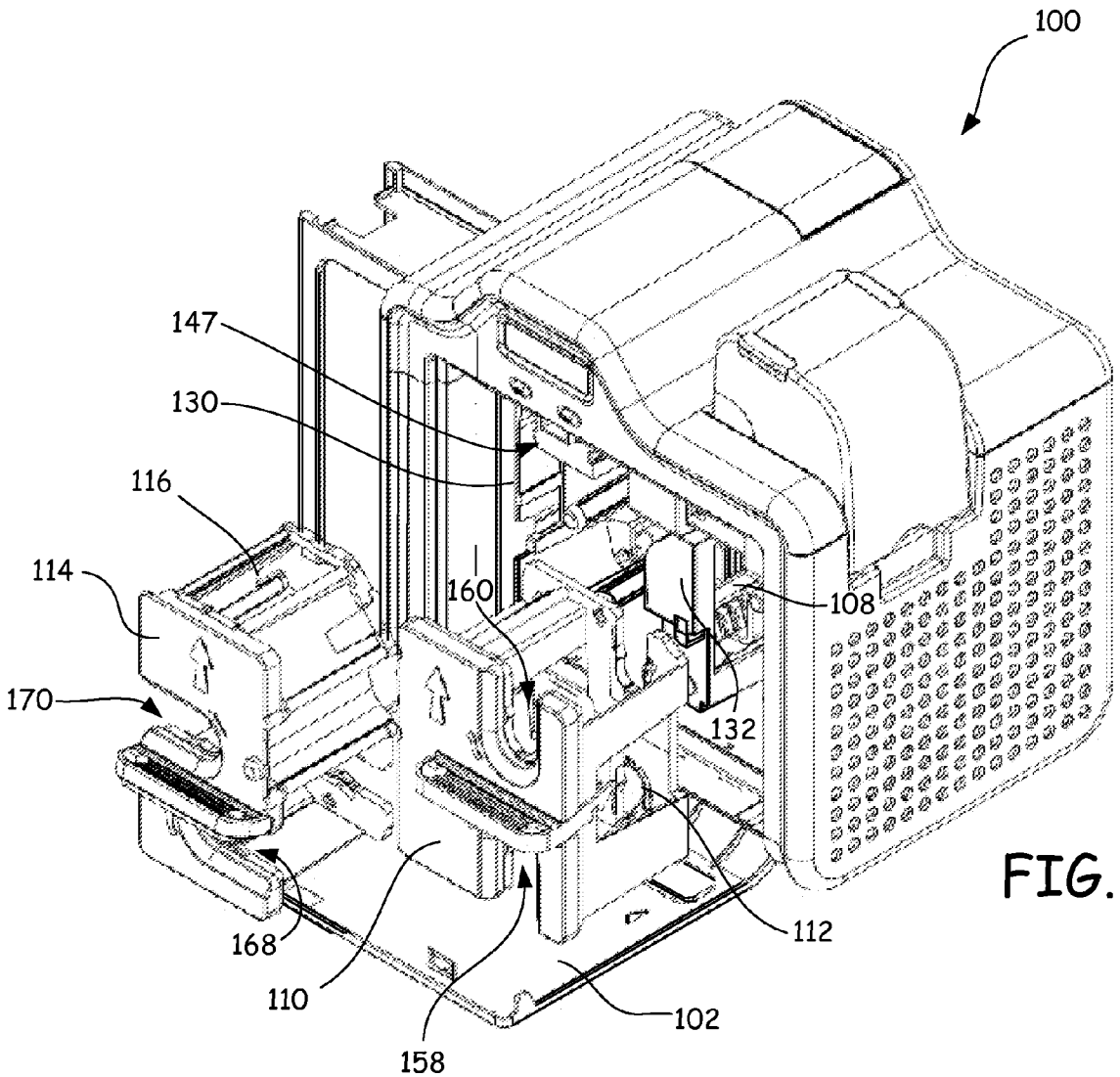
FIG. 2 is an exploded perspective view of the credential printing device of FIG. 1 under embodiments of the invention.
Figure 3:
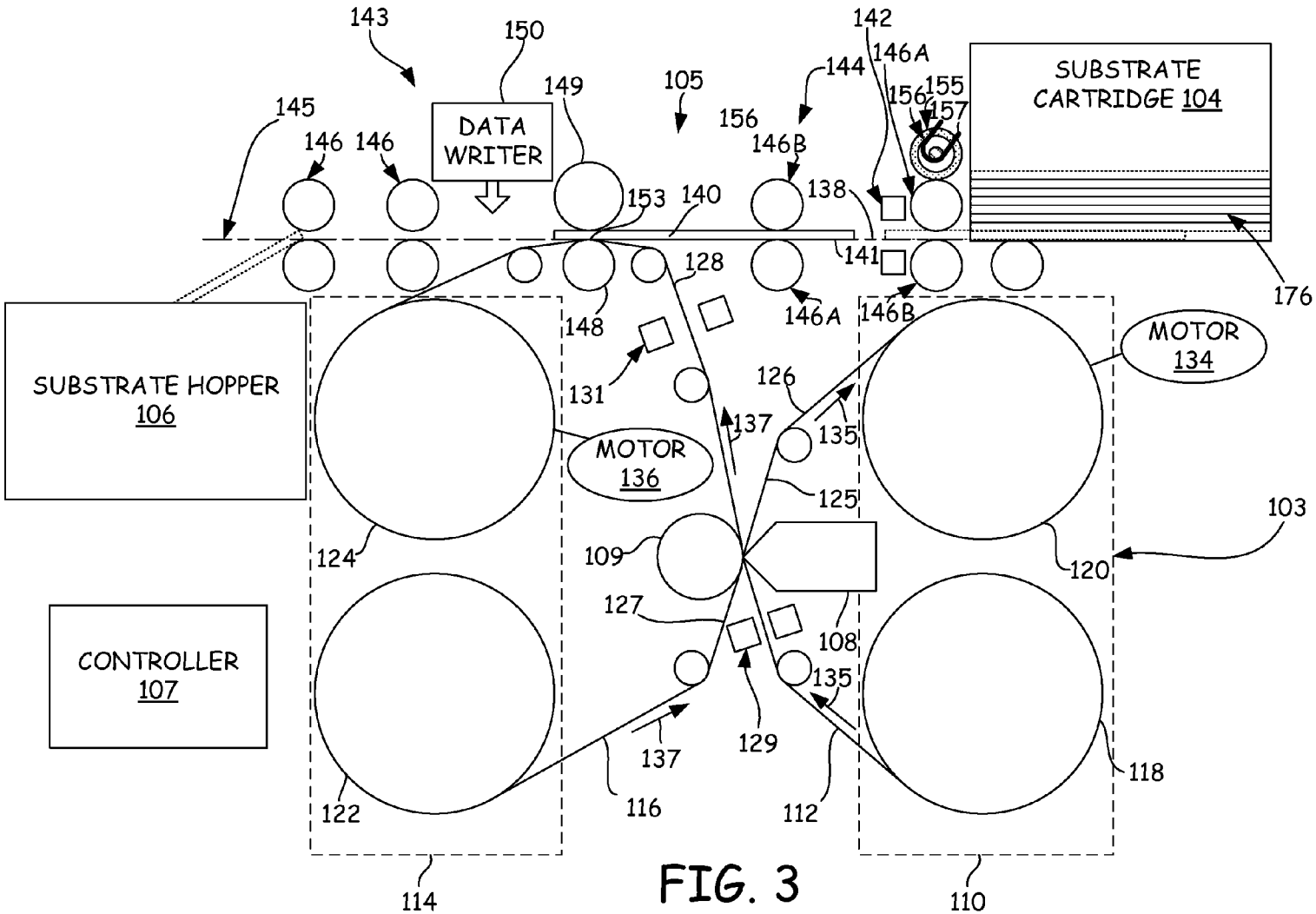
FIG. 3 is a simplified schematic diagram of the credential printing device illustrated in FIGS. 1 and 2.

FIGS. 1 and 2 illustrate perspective views of a credential printing device 100 in accordance with embodiments of the invention. FIG. 3 illustrates a simplified schematic diagram of device 100 in accordance with embodiments of the invention.

FIG. 1 illustrates an exterior view of credential printing device 100 and FIG. 2 illustrates an exploded view of credential printing device 100. Embodiments of the disclosure pertain to credential printing device 100 as being a reverse-image printer and, therefore, embodiments of the disclosure pertain to the use of credential printing device 100 to print credential substrates to form credentials. While device 100 will be described as utilizing credential substrates in the form of card substrates to create identification cards, it should be understood that other credential substrates can be used to form other types of credentials, such as passports and other valuable documents.

Credential printing device 100 provides inverted reverse-image transfer printing using printing components that are inverted relative to a position of printing components in a conventional reverse-image printing device with respect to a print processing path. Unlike conventional printing devices, the inverted nature of credential printing device 100 locates production components below its print processing path. Such a configuration aids in making credential printing device 100 more compact, especially in height, allows heat from a transfer roller to dissipate more efficiently and simplifies a processing path of which a credential substrate is transported.

In the embodiment illustrated in FIG. 1, credential printing device 100 includes an enclosure 101 having a front panel 102. Credential printing device 100 utilizes a substrate cartridge 104, a substrate transport mechanism to transport credential substrates along a print processing path 138 (FIG. 3) to be discharged into a substrate hopper 106. In addition to the location of production components in credential printing device 100 allowing the device to be more compact, configurations of many production components within credential printing device 100 also allow device 100 to be more compact than conventional reverse-image credential printing devices.

In FIG. 2, front panel 102 is removed to more clearly illustrate main production components internal to credential printing device 100. Credential printing device 100 includes a removable print ribbon cartridge 110 and a removable transfer film cartridge 114, both of which are below print processing path 138 (FIG. 3). Print ribbon cartridge 110 and transfer ribbon cartridge 114 are releasable and removable from an internal frame 130 of credential printing device 100 that is configured to house print ribbon cartridge 110 and transfer ribbon cartridge 114. In FIG. 2, print ribbon cartridge 110 includes a supply spool receiver 158 positioned below a take-up spool receiver 160 and transfer ribbon cartridge 114 includes a supply spool receiver 168 positioned below a take-up spool receiver 170, as shown in FIGS. 2 and 3. Supply spool receiver 158 and take-up spool receiver 160 of print ribbon cartridge 110 are configured to receive both ends of a print ribbon 112. Supply spool receiver 168 and take-up spool receiver 170 of transfer ribbon cartridge 114 are configured to receive both ends of a transfer ribbon 116. In other embodiments, the take-up spool receivers in either print ribbon cartridge 110 or transfer ribbon cartridge 114 can be positioned below the supply spool receivers.

When print ribbon cartridge 110 is inserted into credential printing device 100, embodiments of print ribbon cartridge 110 also receive a printhead housing 132 contained in internal frame 130. Printhead housing 132 houses a printhead 108. In addition, when transfer ribbon cartridge 114 is inserted credential printing device 100, embodiments of transfer ribbon cartridge 114 also receive a transfer roller assembly 147 that includes a transfer roller 148 (not illustrated in FIG. 2).

In general, credential printing device 100 includes a printing section 103 and an image transfer section 105. A controller 107 controls the components of credential printing device 100 to perform various operations including substrate feeding, printing an image to a transfer film or ribbon, transferring the image to a substrate, sensor calibration and other operations.

In one embodiment, printing section 103 includes printhead 108, a print platen 109, print ribbon cartridge 110 (FIG. 2) for supporting a print ribbon 112 and a transfer ribbon cartridge 114 (FIG. 2) for supporting a transfer ribbon 116. As illustrated in FIG. 2, cartridges 110 and 114 are releasable and removable from credential printing device 100 for loading and unloading print ribbon 112 and transfer ribbon 116. Print ribbon 112 (e.g., dye sublimation print ribbon) is wound about a supply spool 118 and a take-up spool 120. Supply spool 118 is received by supply spool receiver 158 (FIG. 2) and take-up spool 120 is received by take-up spool receiver 160 (FIG. 2). Transfer ribbon 116 is wound about a supply spool 122 and a take-up spool 124. Supply spool 122 is received by supply spool receiver 168 (FIG. 2) and take-up spool 124 is received by take-up spool receiver 170 (FIG. 2). Print ribbon 112 includes a first surface 125 and a second surface 126 opposite the first surface. When print ribbon 112 is wound about spools 118 and 120, first surface 125 faces the interior of print ribbon cartridge 110 and second surface 126 faces transfer ribbon cartridge 114. Transfer ribbon 116 includes a first surface 127 and a second surface 128 opposite the first surface. When transfer ribbon 116 is wound about spools 122 and 124, first surface 127 faces the interior of transfer ribbon cartridge 114 and second surface 128 faces print ribbon cartridge 110.

Print ribbon 112 and transfer ribbon 116 are fed between printhead 108 and a platen 109. Printhead 108 is positioned within printhead housing 132 (FIG. 2) and allowed to rotate about a rotation path such that heating elements face and apply pressure on print platen 109 and therefore places second side 126 of print ribbon 112 in contact with second surface 128 of transfer ribbon 116. Print ribbon 112 extends between the second surface 128 of transfer ribbon 116 and printhead 108.

In one embodiment, credential printing device 100 includes a print ribbon sensor 129 that operates to detect different color frames or panels of print ribbon 112. The frames or panels repeat in a sequence or group consisting of a yellow, magenta and cyan frames or panels. In addition, print ribbon 112 can include a black resin frame or panel in the sequence of color frames or panels, if desired. Print ribbon sensor 129 detects the colored frames or panels for controller 107, which uses signals derived from the sensed frames or panels to control motor 134. Motor 134 feeds print ribbon 112 in a direction indicated by arrows 135.

In one embodiment, credential printing device 100 includes a transfer ribbon sensor 131. Transfer ribbon sensor 131 is configured to sense transition marks that separate substantially clear or transparent panels along the length of transfer ribbon 116. The transfer film sensor detects the transition marks for the controller 107, which uses signals derived from the sensed transition marks to control motor 136. Motor 136 feeds transfer ribbon 116 in a direction indicated by arrows 137.

While motors 134 and 136 are operating, printhead 108 applies pressure against print platen 109 such that printhead 108 is in contact with first side 125 of print ribbon 112 and brings print ribbon 112 in contact with second side 128 of transfer ribbon 116. In one embodiment, printhead 108 is a thermal printhead having a plurality of burn or heating elements. The burn elements on printhead 108 transfer a reverse-image onto a panel of transfer ribbon 116 using print ribbon 112. Printhead 108 prints each panel of transfer ribbon 116 while oriented approximately perpendicularly to print processing path 138 and positioned below processing path 138. The reverse-image on the panel of transfer ribbon 116 is then moved towards processing path 138 for transferring the reverse-image to a credential substrate 140.

In another embodiment, image transfer section 105 includes a substrate input 142, a substrate transport 143, a transfer mechanism 144 and a substrate output 145. Credential substrate 140 is received by substrate transport 143 from substrate cartridge 104 at substrate input 142. Substrate cartridge 104 includes a stack of credential substrates 176. Controller 107 controls substrate transport 143 to feed individual credential substrates 140 along processing path 138 from a bottom of the stack of credential substrates 176. In one embodiment, processing path 138 is substantially flat between substrate input 142 and substrate output 145 to avoid any bending or damaging of substrates 140, particularly when they are in the form of rigid or semi-rigid plastic card substrates used to form identification cards. At substrate output 145, credential substrate 140 is discharged into substrate hopper 106. Along with components located below print processing path 138 for transferring an image to credential substrate 140, substrate hopper 106 and substrate output 145 are also positioned below print processing path 138. Credential substrate 140, when discharged through substrate output 145 falls into substrate hopper 106. Unlike conventional reverse-image printing devices, such configurations aid in making credential printing device 100 more compact, especially in height, allows heat from transfer roller 148 to dissipate more efficiently and simplifies print processing path 138 of which credential substrate 140 is transported.

Substrate transport 143 includes substrate feed rollers 146A and 146B that are driven by motors through gear and pulley arrangements or other configurations. It should be noted that in some embodiments separate motors can be used for different stages of substrate transport through credential printing device 100. For example, a motor can be used to drive the feeding of a substrate 140 through substrate input 142 and another motor can be used to drive the feeding of substrate 140 through the remaining processing path 138 in credential printing device 100.

When transfer ribbon cartridge 114 is inserted into credential printing device 100, embodiments of transfer ribbon cartridge 114 also receive transfer roller assembly 147 (FIG. 2) that includes transfer roller 148 (FIG. 3). Transfer roller 148 is positioned below print processing path 138 and configured to position transfer ribbon 116 adjacent print processing path 138. Even though transfer ribbon cartridge 114 receives transfer roller assembly 147 when inserted into credential printing device 100, transfer ribbon cartridge 114 allows transfer roller assembly 147 to move and therefore allows transfer roller 148 to apply pressure on a platen 149.

Figure 4:
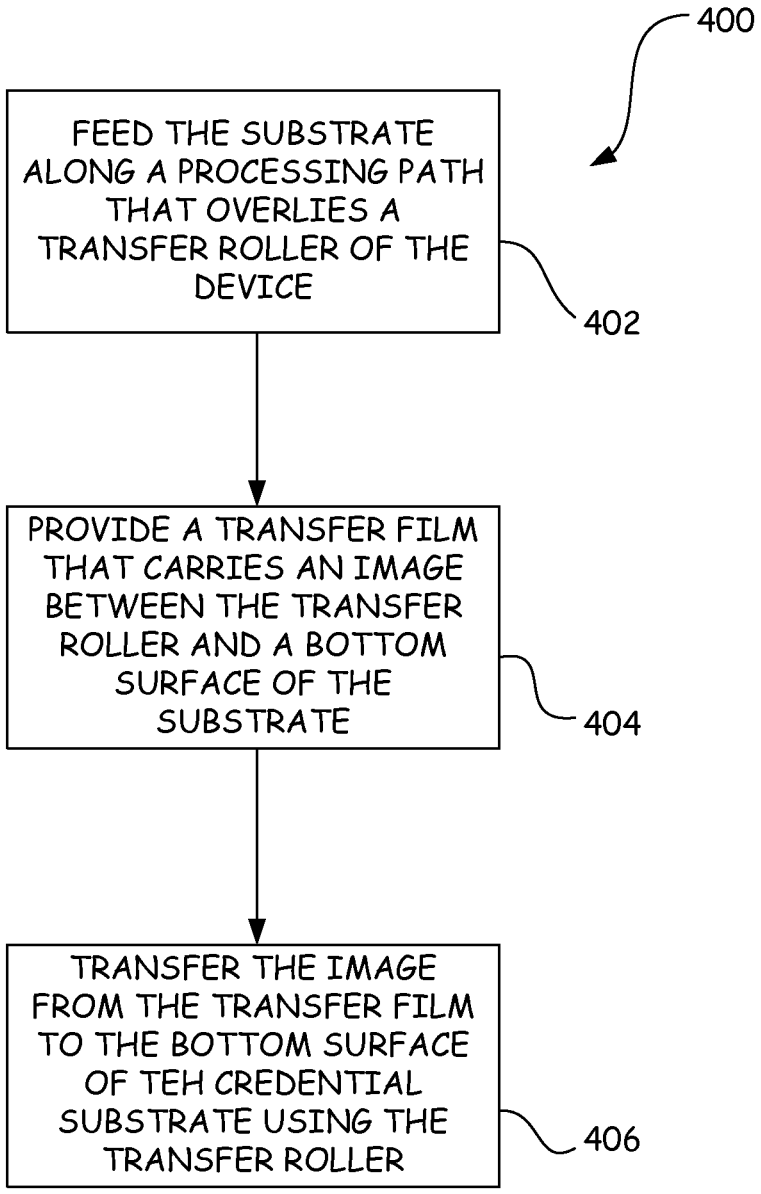
FIG. 4 is a flowchart illustrating a method of processing a credential substrate in accordance with embodiments of the credential printing device illustrated in FIGS. 1-3.

FIG. 4 is flowchart 400 illustrating a method of processing credential substrate 140 (FIG. 3) in credential printing device 100 (FIGS. 1 and 2). At block 402, credential substrate 140 is fed along processing path 138 that overlies transfer roller 148 of credential printing device 100. At block 404, a transfer film 116 which carries an image between transfer roller 148 and a bottom surface 141 of credential substrate is provided. At block 406, the image is transferred from transfer film 116 to bottom surface 141 of credential substrate 140 using transfer roller 148.

With reference back to FIG. 3, during image transfer, transfer roller 148 is configured to transfer an image from transfer ribbon 116 to a bottom surface 141 of credential substrate 140 as credential substrate 140 moves along processing path 138. First surface 127 of transfer ribbon 116 engages a top surface 153 of transfer roller 148, while second surface 128 of transfer ribbon 116 faces processing path 138. Transfer roller 148 presses transfer ribbon 116 and substrate 140 against platen 149 such that the reverse-image printed on transfer ribbon 116 is transferred onto bottom surface 141 of substrate 140. Transfer roller 148 uses heat and pressure to transfer the reverse-image printed on transfer ribbon 116 onto substrate 140.

One embodiment of credential printing device 100 includes a data writer 150. Data writer 150 is positioned between transfer roller 148 and substrate output 145 along print processing path 138, while data writer 150 is being positioned above processing path 138. It can also be positioned below print processing path 138. Data writer 150 is configured to encode substrate 140 with data. In one embodiment, data writer 150 can write data to a magnetic stripe of substrate 140. In one embodiment, data writer 150 can write data to a memory of substrate 140. In another embodiment, credential printing device 100 includes a data reader configured to read data written to a magnetic stripe or memory of a substrate.

One embodiment of credential printing device 100 includes rollers 146A and 156 that are assembled above and below card path 138. Rollers 146A and 156 include a tacky surface for cleaning both sides of card substrate 140. A slot 157 is configured to receive a replaceable cleaning roller 155 having an adhesive surface. Replaceable cleaning roller 155 is configured to remove dirt and debris from rollers 146A and 156. In general, slot 157 faces upward and allows access through the top of the printer near substrate cartridge 104.

Although the present invention has been described with reference to preferred embodiments, workers skilled in the art will recognize that changes may be made in form and detail without departing from the spirit and scope of the invention.

What is claimed is:

1. A reverse-image credential printing device comprising:

a credential substrate transport configured to feed a credential substrate along a processing path, the credential substrate having a bottom surface;

removable transfer ribbon and print ribbon cartridges containing supply and take-up spools that are positioned side-by-side, wherein the supply spool of the transfer ribbon cartridge underlies the take-up spool of the transfer ribbon cartridge;

a transfer ribbon extending between the supply spool and the take-up spool of the transfer ribbon cartridge; and a transfer roller configured to transfer an image from the transfer ribbon to the bottom surface of the credential substrate in the processing path, wherein the transfer roller underlies the processing path and the bottom surface of the credential substrate, but overlies the supply and take-up spools of the transfer ribbon cartridge.

2. The device of claim 1, further comprising a printhead configured to print an image on the transfer ribbon.

3. The device of claim 2, wherein:

the transfer ribbon includes a first surface engaging a top surface of the transfer roller and a second surface facing the processing path; and the device further comprising a print ribbon extending between the second surface of the transfer ribbon and the printhead.

4. The device of claim 1, further comprising a substrate output in the processing path, through which the substrate is discharged from the device.

5. The device of claim 4, further comprising a substrate hopper positioned below the processing path and beneath the substrate output, whereby substrates discharged through the substrate output fall into the substrate hopper.

6. The device of claim 1, further comprising a substrate cartridge adjacent a credential substrate input, the substrate cartridge configured to present individual substrates to the substrate transport at the substrate input for feeding along the processing path.

7. The device of claim 1, further comprising a pair of rollers positioned below and above the processing path and configured to clean the bottom surface of a credential substrate as it is fed along the processing path.

8. The device of claim 7, wherein the substrate cleaner comprises a replaceable cleaning roller received within a slot to clean the pair of rollers positioned below and above the processing path.

9. The device of claim 1, further comprising a data writer configured to write data to one of a magnetic stripe of the substrate and a memory of the substrate.

10. The device of claim 1, wherein the credential substrate comprises a card substrate.

11. A reverse-image credential printing device comprising:

a credential substrate cartridge configured to contain a stack of credential substrates, the credential substrate having a bottom surface;

a substrate transport configured to feed a bottom substrate from the stack of credential substrates along a processing path;

a removable transfer ribbon cartridge containing supply and take-up spools and a transfer ribbon extending between the supply and take-up spools, wherein an axis of rotation of the supply spool is located vertically below an axis of rotation of the take-up spool;

a removable print ribbon cartridge located adjacent to the removable transfer ribbon cartridge and containing supply and take-up spools and a print ribbon extending between the supply and take-up spools, wherein one of an axis of rotation of the supply spool and an axis of rotation of the take-up spool is located vertically below the other of the supply spool or take-up spool;

a printhead positioned below the processing path and configured to print an image on the transfer ribbon using the print ribbon; and a transfer roller positioned below the processing path and vertically above the take-up and supply spools of the transfer ribbon cartridge, the transfer roller configured to transfer the image from the transfer ribbon to the bottom surface of the credential substrate located on the processing path.

12. The device of claim 11, further comprising a substrate output in the processing path, through which the substrate is discharged from the device.

13. The device of claim 12, further comprising a substrate hopper positioned below the processing path and the substrate output, whereby substrates discharged through the substrate output fall into the substrate hopper.

14. The device of claim 11, wherein the credential substrate cartridge is adjacent a credential substrate input, the credential substrate cartridge configured to present individual substrates to the substrate transport at the substrate input for feeding along the processing path.

15. The device of claim 11, further comprising a data writer configured to write data to one of a magnetic stripe of the substrate and a memory of the substrate.

16. The device of claim 11, wherein the credential substrate comprises a card substrate.

17. A method of processing a credential substrate in a credential printing device comprising steps of:

feeding the credential substrate along a processing path that overlies a transfer roller of the device;

providing removable transfer ribbon and print ribbon cartridges containing supply and take-up spools that are positioned side-by-side when located into the credential printing device;

providing a transfer film extending between the supply spool and the take-up spool of the transfer ribbon cartridge that carries an image; and transferring the image from the transfer film to a bottom surface of the credential substrate using the transfer roller, wherein the transfer roller underlies the processing path and the bottom surface of the credential substrate, but vertically overlies the supply and take-up spools.

18. The method of claim 17, further comprising printing the image to the transfer ribbon.

19. The method of claim 17, further comprising cleaning the bottom and the top surface of the substrate prior to the transferring step.

20. The method of claim 17, further comprising receiving the credential substrate from a credential substrate cartridge at a substrate input.

21. The method of claim 17, further comprising discharging the credential substrate following the transferring step through a substrate output and collecting the discharge substrate in a hopper positioned below the substrate output.

22. The method of claim 17, further comprising feeding the credential substrate from a bottom of a stack of credential substrates.

23. The method of claim 17, further comprising writing data to the credential substrate.

* * * * *